US005873018A

United States Patent [19]

Aoto et al.

[11] Patent Number: 5,873,018

[45] Date of Patent: Feb. 16, 1999

[54] IMAGE FORMING APPARATUS HAVING AN INTERMEDIATE TRANSFER UNIT WITH A SURFACE HAVING REDUCED COEFFICIENT OF FRICTION

[75] Inventors: Jun Aoto, Fuji; Yasuo Hirano; Masahide Yamashita, both of Numazu; Mitsuru Seto, Kanagawa-ken; Shigeru Fukuda, Kawasaki, all of Japan

[73] Assignee: Ricoh Company, Ltd., Tokyo, Japan

[21] Appl. No.: 832,801

[22] Filed: Apr. 4, 1997

Related U.S. Application Data

[63] Continuation-in-part of Ser. No. 639,961, Apr. 29, 1996.

[30] Foreign Application Priority Data

May 16, 1995 [JP] Japan ..... 7-117273
Apr. 8, 1996 [JP] Japan ..... 8-085400

[51] Int. Cl.[6] ..... G03G 15/16

[52] U.S. Cl. ..... 399/302; 399/308; 430/126

[58] Field of Search ..... 399/302, 308, 399/313; 430/126

[56] References Cited

U.S. PATENT DOCUMENTS 5,430,533 7/1995 Dreyfuss ..... 399/313 X
5,572,304 11/1996 Seto et al. .

FOREIGN PATENT DOCUMENTS 59-23975 2/1984 Japan .
59-50475 3/1984 Japan .
2-198476 8/1990 Japan .
2-213881 8/1990 Japan .
5-142955 6/1993 Japan .

*Primary Examiner*—R. L. Moses
*Attorney, Agent, or Firm*—Oblon, Spivak, McClelland, Maier & Neustadt, P.C.

[57] ABSTRACT

An image forming apparatus comprises an intermediate transfer unit associated with a photoconductive medium. A first unit transfers a developed image on the photoconductive medium to the intermediate transfer unit such that an intermediate image on the intermediate transfer unit is formed. A second unit transfers the intermediate image from the intermediate transfer unit to a copy sheet such that a reproduced image on the copy sheet is formed. The intermediate transfer device of one aspect of the present invention comprises a surface layer of a mixture containing a friction reducing substance which reduces a coefficient of friction on the surface layer. The intermediate transfer device of another aspect of the present invention comprises a surface layer of a mixture containing a fluorocarbon polymer component and a secondary resin component which are compatible with each other, a visible developed color image being formed on the surface layer.

20 Claims, 4 Drawing Sheets

IMAGE FORMING APPARATUS HAVING AN INTERMEDIATE TRANSFER UNIT WITH A SURFACE HAVING REDUCED COEFFICIENT OF FRICTION

This application is a continuation-in-part of Ser. No. 08/639,961.

BACKGROUND OF THE INVENTION (1) Field of the Invention

The present invention generally relates to an image forming apparatus using an electrophotographic technique, and more particularly to an image forming apparatus in which an intermediate image, transferred from an electrophotographic photoconductive medium to an intermediate transfer unit, is transferred from the intermediate transfer unit to a copy sheet so that a reproduced image is formed.

(2) Description of the Related Art

Recently, electrophotographic image forming systems which are capable of forming a multiple-color or full-color image have come into practical use. These systems include a color copier system, a color printer system and a color facsimile system.

In the image forming system of the above type, a full-color image is transferred to a copy sheet as follows. Each of developed images in secondary colors (including cyan, magenta, yellow and black) is formed on a rotary photoconductive drum with a corresponding color toner or developer. These developed images are sequentially transferred to an intermediate transfer unit by a first transfer process, so that an intermediate full-color image is formed on the intermediate transfer unit. The intermediate full-color image on the intermediate transfer unit is transferred to a copy sheet by a second transfer process so that a reproduced full-color image is formed on the copy sheet.

The color toners which remain on the surface of the intermediate transfer unit after the second transfer process are removed by a cleaning blade, so that the surface of the intermediate transfer unit is cleaned and is ready for a subsequent transfer process.

In the above-described image forming system, an endless belt member arranged between a drive roller and follower rollers under a tensile stress is used as the intermediate transfer unit. The endless belt member is in contact with the rotary photoconductive drum at one location of the endless belt member. Each of the developed images, formed with one of the color toners on the photoconductive drum, is transferred to the intermediate transfer unit to form the intermediate color image on the intermediate transfer unit.

There are two types of intermediate transfer units which are used for the image forming system. One of the two types is an intermediate transfer unit which is formed with a dielectric material, or an intermediate transfer unit having at least a toner-transferred surface which is formed with a dielectric material. The other type is an intermediate transfer unit which is formed by using a medium-resistance material.

The image forming apparatus of the present invention uses the intermediate transfer unit of the latter which is formed by using a medium-resistance material. The intermediate transfer unit of this type is used to eliminate the problem of non-transfer defect of a reproduced image on a copy sheet to which an intermediate image on the intermediate transfer unit is transferred.

There are several publications in the prior art which teach improvements related to the transfer efficiency from the photoconductive medium to the intermediate transfer unit and/or the transfer efficiency from the intermediate transfer unit to the copy sheet so as to increase the quality of the reproduced image. The above-mentioned publications are as follows.

Japanese Laid-Open Patent Application No.59-50475 teaches an intermediate transfer unit having a surface with a specific surface roughness or having an adhesion-layer surface, which is formed so as to improve the transfer efficiency.

Japanese Laid-Open Patent Application No.59-23975 teaches an intermediate transfer unit having a surface of an addition-polymer silicone rubber which is formed so as to improve the transfer efficiency.

Japanese Laid-Open Patent Application No.2-213881 teaches an intermediate transfer unit having a surface formed with a protective layer of zinc stearate, which provides a lubrication on the protective layer so as to improve the transfer efficiency.

Japanese Laid-Open Patent Application No.2-198476 teaches an intermediate transfer unit including fluororesin or silicon resin which provides a small wettability of the intermediate transfer unit so as to improve the transfer efficiency.

Japanese Laid-Open Patent Application No.5-142955 teaches that the intermediate transfer unit is electrically grounded, which prevents the interference between primary transfer electric field and secondary transfer electric field, so as to improve the transfer efficiency.

In order to provide a desired level of optical density of a reproduced image, it is necessary that the transfer toner ratio of the amount of toner (the reproduced image) on the copy sheet to the amount of toner (the intermediate image) on the intermediate transfer unit is 90% or above. The image forming apparatus of one or any combination of the above-mentioned prior art references takes only a macro measure and is directed to increasing the transfer toner ratio to 90% or above.

However, even if the transfer efficiency is above 90%, a small amount of toner may remain on the intermediate transfer unit as pinpoint spots and it may not be transferred to the copy sheet. In such a case, the reproduced image on the copy sheet has non-transfer spots in a microscopic view. The occurrence of non-transfer spots in the reproduced image will lower the quality of the reproduced image. Hereinafter, this problem is called the non-transfer defect of the reproduced image.

The image forming apparatus of any combination of the above-mentioned prior art references takes no countermeasure against the occurrence of the non-transfer spots in the reproduced image, and is not effective to eliminate the non-transfer defect in the reproduced image in the microscopic view.

SUMMARY OF THE INVENTION

An object of the present invention is to provide an improved image forming apparatus in which the above-described problems are eliminated.

Another object of the present invention is to provide an image forming apparatus which efficiently transfers an intermediate image on an intermediate transfer unit, formed from a developed image on the photoconductive medium, to the copy sheet such that a reproduced image on the copy sheet is formed, and the quality of the reproduced image is improved.

Still another object of the present invention is to provide an image forming apparatus which provides a good toner-releasing characteristic of an intermediate transfer unit, so that a good cleaning efficiency of the intermediate transfer unit is obtained.

A further object of the present invention is to provide an intermediate transfer unit which provides a good characteristic of the quantity of frictional charge with the toner from the photoconductive medium, and provides a good toner-releasing characteristic, so that an intermediate image on the intermediate transfer unit is efficiently transferred to the copy sheet and the reproduced image on the copy sheet do not include no-transfer spots therein.

The above-mentioned objects of the present invention are achieved by an image forming apparatus which comprises: a photoconductive medium; an intermediate transfer unit associated with the photoconductive medium; a first unit which transfers a developed image on the photoconductive medium to the intermediate transfer unit such that an intermediate image on the intermediate transfer unit is formed; and a second unit which transfers the intermediate image from the intermediate transfer unit to a copy sheet such that a reproduced image on the copy sheet is formed, the intermediate transfer unit comprising a surface layer of a mixture containing a friction reducing substance which reduces a coefficient of friction on said surface layer.

The above-mentioned objects of the present invention are achieved by an intermediate transfer unit, for use in an image forming apparatus which comprises: a photoconductive medium; a first unit which transfers a visible developed color image from the photoconductive medium to the intermediate transfer unit such that an intermediate color image on the intermediate transfer unit is formed; and a second unit which transfers the intermediate color image from the intermediate transfer unit to a copy sheet such that a reproduced color image on the copy sheet is formed, the intermediate transfer unit comprising a surface layer of a mixture containing a fluororesin component and a secondary resin component which are compatible with each other, the visible developed color image being formed on the surface layer.

The intermediate transfer unit of the present invention has a surface layer of a mixture including the friction reducing substance, and the image forming apparatus incorporating the intermediate transfer unit provides a good toner-releasing characteristic. Further, the intermediate transfer unit of the present invention provides a good characteristic of the quantity of frictional charge with the toner. It is possible that the image forming apparatus of the present invention remarkably improve the quality of the reproduced image which contains no non-transfer spots therein. Further, the intermediate transfer unit of the present invention provides a good cleaning efficiency related to the toner and effectively eliminates the problem of the non-transfer defect of the reproduced image.

BRIEF DESCRIPTION OF THE DRAWINGS

Other objects, features and advantages of the present invention will become more apparent from the following detailed description when read in conjunction with the accompanying drawings in which.

DETAILED DESCRIPTION OF THE PREFERRED EMBODIMENTS

A description will now be given of the preferred embodiments of the present invention with reference to the accompanying drawings.

Figure 1:
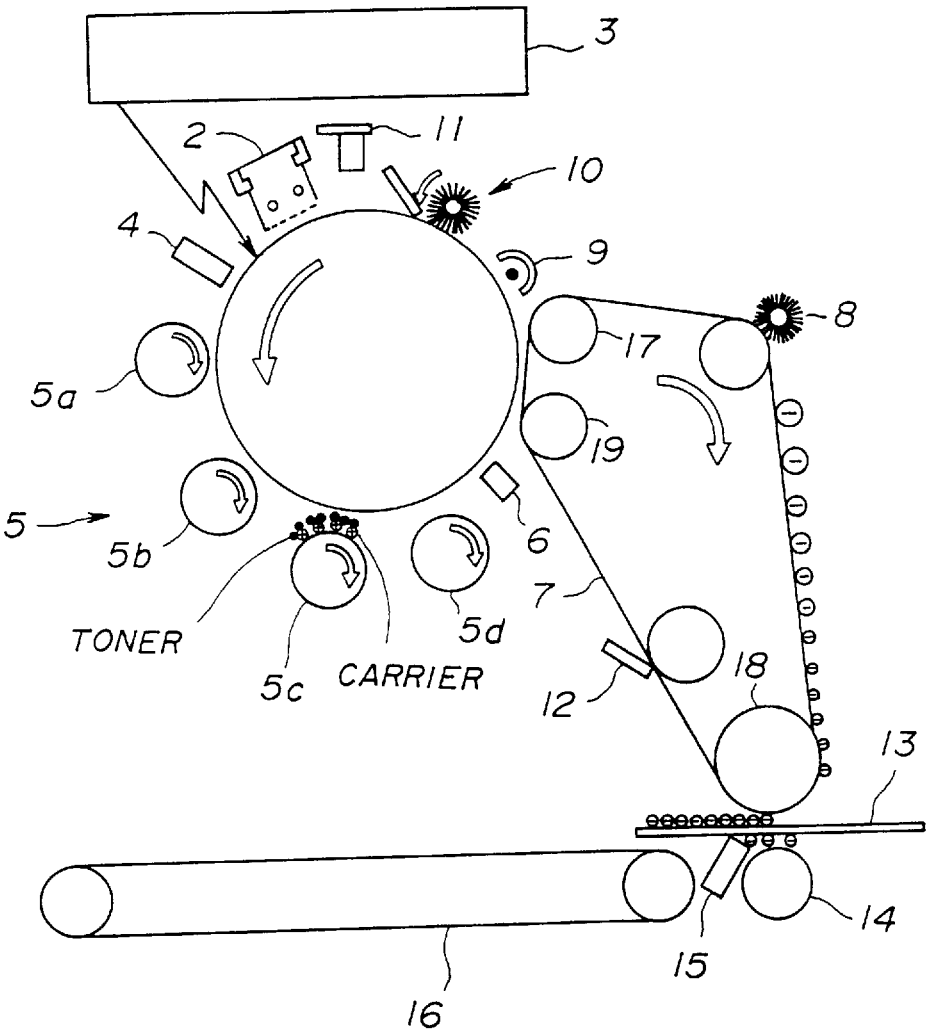
FIG. 1 is a diagram of an image forming apparatus in which an intermediate transfer unit in one embodiment of the present invention is incorporated.

FIG. 1 shows a full-color image forming apparatus using an intermediate transfer unit to which one embodiment of the present invention is applied. Only a printing unit of the full-color image forming apparatus is shown in FIG. 1. However, a part of one of a color copier system, a color facsimile system and a color printer system is constituted by the image forming apparatus of the present invention. In a case of the color copier system, the image forming apparatus includes an image reading unit (not shown in FIG. 1) which reads image data from an original image, as well as the printing unit shown in FIG. 1.

In the color copier system, the image reading unit reads image data from an original image for each of primary colors including red, green and blue. The color-separated image data read by the image reading unit is converted into primary-color-separated image signals. An image processing unit of the color copier system performs a color transformation from the primary-color-separated image signals to secondary-color-separated image signals. The image processing unit generates the secondary-color-separated image signals in accordance with intensities of the primary-color-separated image signals, for each of secondary colors including cyan, yellow, magenta and black.

The printing unit of the image forming apparatus, shown in FIG. 1, forms developed images on a rotary photoconductive drum 1 in accordance with the secondary-color-separated image signals by using color toners for each of the secondary colors. These developed images are sequentially transferred to an intermediate transfer unit at the first transfer process, so that an intermediate color image is formed on the intermediate transfer unit. The intermediate color image from the intermediate transfer unit is transferred to a copy sheet at the second transfer process, so that a reproduced color image is formed on the copy sheet.

Referring to FIG. 1, the construction and operation of the image forming apparatus will be described. In the image forming apparatus, an optical writing unit 3 converts the secondary-color-separated image signals from the image reading unit into optical signals, and performs an optical writing to the rotary photoconductive drum 1 by using the optical signals in accordance with the original image, for each of the secondary colors.

The optical writing unit 3 is, for example, a laser diode unit which deflects a laser beam from a laser diode by using a rotary polygon mirror and emits the deflected laser beam to scan the photoconductive drum 1 by using a constant-speed scanning optical system such as fΘ lens. Accordingly, an electrostatic latent image is formed on the rotary photoconductive drum 1 by the optical writing unit 3.

There are optical writing units of other types which are different from the above-mentioned optical writing unit 3 and can be used instead for the above image forming apparatus. For example, an optical writing unit using a light emitting diode array, and an optical writing unit using a liquid crystal shutter array can be used instead of the above optical writing unit 3.

The photoconductive drum 1 which is an electrophotographic photoconductive medium to carry a developed image thereon is rotated at a constant rate counterclockwise in a rotating direction indicated by the arrow in FIG. 1. At peripheral portions of the photoconductive drum 1, a charging unit 2, a potential sensor 4, a developing unit 5, a developing optical density pattern sensor (P sensor) 6, an endless-belt-type intermediate transfer unit 7, a before-cleaning charge eliminating unit (Pcc) 9, a drum cleaning unit 10 (including a cleaning brush and a cleaning blade), and a charge eliminating lamp 11 are arranged as shown. An electrophotographic image forming process is carried out by these elements of the image forming apparatus.

The developing unit 5 includes a black (Bk) developing member 5*a*, a cyan (C) developing member 5*b*, a magenta (M) developing member 5*c*, and a yellow (Y) developing member 5*d*. A developer of each developing member is a two-component developing agent which contains a coloring agent (toner) and a charge carrier. In FIG. 1, only developing sleeves of the developing members of the developing unit 5 are illustrated, and each developing member, a developing paddle of each developing member and a developer supplementing member of each developing member are omitted.

When the electrophotographic image forming process for one of the secondary colors is started, the rotary photoconductive drum 1 is charged by the charging unit 2. An electrostatic latent image for the first one (for example, Bk) of the secondary colors is formed on the photoconductive drum 1 by the optical writing unit 3 in accordance with the black color-separated image signal. A black-toner developed image is formed on the photoconductive drum 1 with the black toner of the black developing member 5*a* of the developing unit 5.

The black-toner developed image on the photoconductive drum 1 is transferred at the contact location to the intermediate transfer unit 7 so that an intermediate image of black is formed on the intermediate transfer unit 7. The intermediate transfer unit 7 is rotated clockwise in a direction indicated by the arrow in FIG. 1. A rotating speed of the intermediate transfer unit 7 is the same as the rotating speed of the rotary photoconductive drum 1. This transferring process is called the first transfer process.

After the first transfer process, the before-cleaning charge of the photoconductive drum 1 is eliminated by the before-cleaning charge eliminating unit 9. The color toner which remains on the surface of the rotary photoconductive drum 1 after the first transfer process is removed by the drum cleaning unit 10. The remaining charge of the photoconductive drum 1 at this time is eliminated by the charge eliminating lamp 11.

The electrophotographic image forming process for subsequent ones of the secondary colors is performed. The above electrostatic latent image forming, the above color-toner developed image forming and the above first transfer process are repeated for the subsequent ones of the secondary colors C, M, and Y. Since the above image forming processes for the subsequent ones of the secondary colors are repeated, a full-color intermediate image is formed on the intermediate transfer unit 7.

There is also a case in which the full-color image forming is performed for only the three colors including cyan, magenta and yellow.

The intermediate transfer unit 7 is comprised of an endless belt member. The endless belt member of the intermediate transfer unit 7 is arranged under the tensile stress by a drive roller 18, a belt-transfer biasing roller 17, a transfer-grounding roller 19 and follower rollers.

The intermediate transfer unit 7 is rotated clockwise in the direction indicated by the arrow in FIG. 1. Since the intermediate transfer unit 7 is in contact with the photoconductive drum 1 under the tensile stress, the above first transfer processes for the secondary colors are performed when the belt-transfer biasing roller 17 is subjected to a predetermined bias voltage.

At peripheral portions of the endless-belt-type intermediate transfer unit 7, a sweeper brush 8, a sheet-transfer biasing roller 14 and a belt-cleaning unit 12 (including a cleaning blade and a brush roller) are arranged as shown. These elements are separated from the intermediate transfer unit 7 when the first transfer process for the secondary colors is being performed, and brought into contact with the intermediate transfer unit 7 during the second transfer process. A mechanism which separates the above elements from the intermediate transfer unit 7 and brings the above elements into contact with the intermediate transfer unit 7 again is not shown in FIG. 1.

As the intermediate image is formed on the intermediate transfer unit 7, the sheet-transfer biasing roller 14 is brought in contact with the intermediate transfer unit 7 via a copy sheet 13. The intermediate image on the intermediate transfer unit 7 is transferred at the contact location to the copy sheet 13, so that a reproduced color image is formed on the copy sheet 13. This transferring process is called the second transfer step. The sheet-transfer biasing roller 14 is called the transferring member.

The copy sheet 13 on which the reproduced color image is formed is separated from the intermediate transfer unit 7 by a separating member 15. The copy sheet 13 is transported by a transporting belt 16 to a fixing unit (not shown in FIG. 1). After a fixing process for the copy sheet 13 is performed by the fixing unit, the copy sheet 13 with the reproduced color image is output from the image forming apparatus.

On the other hand, after the second transfer step is performed, the belt cleaning unit 12 and the sweeper brush 8 are brought into the intermediate transfer unit 7. The toner and charge which remains on the surface of the intermediate transfer unit 7 after the second transfer step is removed by the sweeper brush 8 and the belt cleaning unit 12.

As described above, the intermediate image on the intermediate transfer unit 7 is transferred to the copy sheet 13 at the second transfer step so that a reproduced image is formed on the copy sheet. In order to obtain a desired level of optical density of the reproduced image, it is necessary that the transfer efficiency related to the transferring of the amount of toner (the intermediate image) on the intermediate transfer unit 7 to the amount of toner (the reproduced image) on the copy sheet 13 is above 90%. Even if the transfer efficiency is above 90%, a small amount of toner may remain on the intermediate transfer unit as pinpoint spots and it may not be transferred to the copy sheet 13. In such a case, the reproduced image on the copy sheet has non-transfer spots. The occurrence of non-transfer spots in the reproduced image will lower the quality of the reproduced image. This problem is called the non-transfer defect.

The inventors of the present invention have found that an intermediate transfer unit having a surface layer of a mixture containing a friction reducing substance allows an intermediate image on the intermediate transfer unit to be efficiently transferred to a copy sheet. Also, they have found that the above intermediate transfer unit provides a good toner-releasing characteristic for the image forming apparatus, thereby eliminating the problem of the non-transfer defect in a reproduced image. The friction reducing substance reduces a coefficient of friction on the surface layer of the intermediate transfer unit, and increases the transfer efficiency of the intermediate transfer unit.

It has been found desirable that the surface layer of the intermediate transfer unit has a coefficient of static friction smaller than or equal to 0.3 and a coefficient of dynamic friction smaller than or equal to 0.3. It is observed that the problem of the non-transfer defect takes place if the coefficient of static friction or the coefficient of dynamic friction of the intermediate transfer unit is above 0.3.

Specific examples of the friction reducing substance contained in the surface layer of the intermediate transfer unit according to the present invention are as follows: a solid inorganic lubricant, such as molybdenum disulfide, lead oxide, graphite, boron nitride, calcium fluoride or carbon fluoride; and an organic resin, such as a polyolefin resin, a polyamide resin, a polyimide resin or any of a long-chain fatty acid, a derivative of the fatty acid, and a compound containing the fatty acid and/or the derivative of the fatty acid.

It has been found desirable that the surface layer of the intermediate transfer unit contains fine particles of the inorganic lubricant or the organic resin. Examples of the polyolefin resin whose fine particles are contained in the intermediate transfer unit are polyethylene, polypropylene, and so on.

Specific examples of the above fatty acid, the above derivative and the above compound are as follows: a natural wax, such as candelilla wax, carnauba wax, montan wax, or beeswax; a synthetic wax, such as cured castor oil, fatty ester, N-substituent fatty acid amide, 12-hydroxy acid and its derivative, or monohydric or polyhydric alcohol fatty acid; a long-chain fatty acid having a number of carbon atoms greater than or equal to twelve, such as lauric acid, stearic acid, oleric acid, docosanoic acid, or palmitic acid; a metal soap, such as zinc stearate, lithium stearate, zinc oleate, or lithium hydroxystearate; a derivative of any of the above fatty acids; and a compound or composite material including any of the above fatty acids and/or any of the above derivative.

A mixture of two or more of the above-mentioned examples of the friction reducing substance which is fused and kneaded may be contained in the surface layer of the intermediate transfer unit of the present invention.

It is necessary to select any of the above examples of the friction reducing substance which can suitably blend with the material of the substrate of the intermediate transfer unit.

It has been found desirable that the above long-chain fatty acid, contained in the surface layer of the intermediate transfer unit, has a number of carbon atoms greater than or equal to twelve, and has a melting point of 50° C. or above. It is observed that the problem of the non-transfer defect takes place if a fatty acid whose number of carbon atoms is below 12 is contained in the mixture of the surface layer of the intermediate transfer unit.

The intermediate transfer unit of the present invention can be prepared by mixing ingredients of the friction reducing substance and molding the mixture such that it has a single-layer structure.

Figure 2:
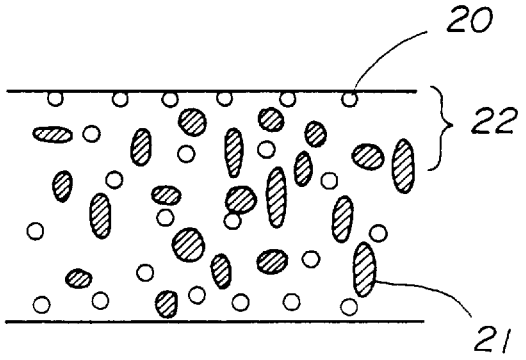
FIG. 2 is an enlarged cross-sectional view of an intermediate transfer unit of a single-layer structure.

FIG. 2 is an enlarged cross-sectional view of the intermediate transfer unit of a single-layer structure. In FIG. 2, reference numeral 20 indicates a particle of the friction reducing substance, and reference numeral 21 indicates a particle of a conducting filler.

In this case, the friction reducing substance 20 is mixed with the material of the substrate of the intermediate transfer unit when forming the intermediate transfer unit, and the intermediate transfer unit having a surface of the mixture containing the friction reducing substance 20 is formed by extrusion molding or injection molding.

It has been found desirable that the weight ratio of the friction reducing substance contained in the mixture is between 1 part and 50 parts. It is observed that the problem of the non-transfer defect takes places if the weight ratio of the friction reducing substance is below 1 part, and the surface smoothness and durability of the intermediate transfer unit is lowered if the ratio of the friction reducing substance is above 50 parts by weight.

In addition, it has been found desirable that the average diameter of particles of the friction reducing substance in the above mixture is below 10 $\mu$m. It is observed that the surface smoothness of the intermediate transfer unit is lowered if the average diameter is above 10 $\mu$m.

Further, it has been found desirable that the surface layer of the intermediate transfer unit has a volume resistivity of in the range between $1\times10^{8}$ Ω·cm (ohm centimeter) and $1\times10^{14}$ Ω·cm. It is observed that a discharging of the transfer bias, a disturbance of the reproduced image or a damage of the photoconductive medium may take place if the volume resistivity is below $1\times10^{8}$ Ω·cm. It is observed that an insufficient level of the transfer bias or a problem of the transferring from the photoconductive medium to the intermediate transfer unit may take place if the volume resistivity is above $1\times10^{14}$ Ω·cm. It is observed that a charge storage of the intermediate transfer unit or a residual image reproduction may take place if the volume resistivity is above $1\times10^{14}$ Ω·cm.

The intermediate transfer unit of the present invention can be formed such that it has a multiple-layer structure.

Figure 3:
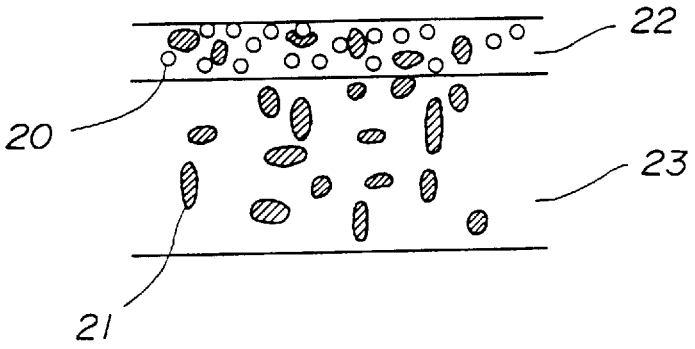
FIG. 3 is an enlarged cross-sectional view of an intermediate transfer unit of a multiple-layer structure.

FIG. 3 is an enlarged cross-sectional view of the intermediate transfer unit of the multiple-layer structure. In FIG. 3, reference numeral 22 indicates the surface layer, and reference numeral 23 indicates the substrate. In this case, it is necessary that the friction reducing substance 20 is contained at least in a mixture of the surface layer 22 of the intermediate transfer unit.

In the case of the intermediate transfer unit of the multiple-layer structure, the surface layer 22 of the intermediate transfer unit may be formed by using either the extrusion or injection molding method (the same as described above) or a coating method.

When the surface layer 22 is formed by using the coating method, a coating liquid of the mixture is sprayed, dipped or cast to the substrate 23 of the intermediate transfer unit. The friction reducing substance is mixed with a dispersion medium such as water or organic solvent, and the mixture is dispersed by using a ball mill, sand mill or the like such that the average diameter of particles of the friction reducing substance 20 in the above mixture is below a predetermined diameter. The coating liquid is prepared by mixing the above mixture with a resin material.

In the case of the intermediate transfer unit of the multiple-layer structure, the substrate 23 of the intermediate transfer unit is, for example, a thermoplastic resin of any of polyethylene, polystyrene, polyvinyl chloride, polyester, nylon, polycarbonate, polyacrylonitrile, polyvinylidene fluoride, and ethylene-tetrafluoroethylene copolymer. Further, an organic conducting filler, such as polyethylene oxide, polyaniline, polypyrrole or class-4 ammonium salt, or an inorganic conducting filler, such as carbon black, zinc oxide or any other metal particle, is added to the above material of the substrate, and the mixture is prepared such that the substrate 23 has a desired value of resistivity.

In the case of the intermediate transfer unit of the multiple-layer structure, a coating of the surface layer which is either the above-mentioned thermoplastic resin or a thermosetting resin of any of phenol resin, urea resin, melamine resin, silicone resin, fluororesin and acrylic resin can be used.

It has been found desirable that the surface layer of the intermediate transfer unit of the multiple-layer structure has a surface resistivity of in the range from $1\times10^{7}\Omega$ (ohm) to $1\times10^{13}\Omega$. It is observed that a discharging of the transfer bias, a disturbance of the reproduced image or a damage of the photoconductive medium may take place if the surface resistivity is below $1\times10^{7}\Omega$. It is also observed that a charge storage of the intermediate transfer unit or a residual image reproduction may take place if the surface resistivity is above $1\times10^{13}\Omega$.

The surface resistivity and the volume resistivity of the examples are measured by using a measuring instrument "Hiresta" from Mitsubishi Petrochemical Co., Ltd. The applied voltage is 500 V, and the measuring time is 10 seconds.

The coefficient of static friction and the coefficient of dynamic friction of the examples are measured by using an analyzer "Friction Abrasion Analyzer DF.PM-SS" from Kyowa Interface Science Co., Ltd. A measuring load of the stainless-steel ball of this analyzer during the test is set to 100 g.

EXAMPLE 1 (EX.1)

| Ingredients: | |
|---|---|
| poly(vinylidene fluoride) ("KF-850" from Kureha Chemical Industry Co., Ltd.) | 100 parts by weight |
| carbon black ("Printex 40" from Degussa AG) | 15 parts by weight |
| molybdenum disulfide | 20 parts by weight |

An intermediate transfer belt is prepared from the above ingredients. A mixture of the above ingredients is fused and kneaded. Extrusion molding of the mixture of the above ingredients is performed so that a seamless intermediate transfer belt is prepared as the intermediate transfer belt of this example.

As a result of the measurement of the above Example 1, the coefficient of static friction is 0.26, the coefficient of dynamic friction is 0.21, and the volume resistivity is $2\times10^{9}$ $\Omega\cdot$cm (ohm centimeter).

EXAMPLE 2 (EX.2)

| Ingredients of Substrate: | |
|---|---|
| poly(vinylidene fluoride) | 100 parts by weight |
| carbon black | 15 parts by weight |
| molybdenum disulfide | 20 parts by weight |
| Ingredients of Surface Layer: | |
| fluororesin ("Lumiflon 601C" from Asahi Glass Co., Ltd.) | 100 parts (solid) |
| curing agent (for use with "Lumiflon 601C") | 20 parts |
| carbon black ("BP-L" from Cabot Corp.) | 7 parts |
| boron nitride | 20 parts |
| methyl isobutyl ketone | 200 parts |
| xylene | 100 parts |

A substrate of an intermediate transfer belt of this example is prepared from the materials which are the same as those of the above Example 1. A mixture of the above ingredients is fused and kneaded. Extrusion molding of this mixture is performed so that a seamless intermediate transfer belt is prepared as the substrate of the intermediate transfer belt of this example.

A mixture of the above ingredients of the surface layer is milled about 60 hours by using a ball mill. The mixture is sprayed to the above substrate of the intermediate transfer belt so that the surface layer of the intermediate transfer belt is formed.

As a result of the measurement of the above Example 2, the coefficient of static friction is 0.25, the coefficient of dynamic friction is 0.22, and the surface resistivity is $4\times10^{10}\Omega$.

EXAMPLE 3 (EX.3)

An intermediate transfer belt is prepared from the ingredients which are the same as those of the above Example 1 except fine particles of a polyimide resin ("BANI-M" from Maruzen Petrochemical Co., Ltd.) are substituted for molybdenum disulfide in the above Example 1. A mixture of the materials is fused and kneaded. Extrusion molding of this mixture is performed so that a seamless intermediate transfer belt is prepared as the intermediate transfer belt of this example is thus prepared.

As a result of the measurement of the above Example 3, the coefficient of static friction is 0.18, and the coefficient of dynamic friction is 0.13.

EXAMPLE 4 (EX.4)

An intermediate transfer belt is prepared from the ingredients which are the same as those of the above Example 1 except fine particles of a polyethylene resin ("Luwax OA5" from BASF; melting point 128° C.) are substituted for molybdenum disulfide in the above Example 1. A mixture of the materials is fused and kneaded. Extrusion molding of this mixture is performed so that a seamless intermediate transfer belt is prepared as the intermediate transfer belt of this example is thus prepared.

As a result of the measurement of the above Example 4, the coefficient of static friction is 0.19, and the coefficient of dynamic friction is 0.15.

EXAMPLE 5 (EX.5)

The substrate of the intermediate transfer belt of this example is the same as that of the above Example 2.

The ingredients of the surface layer of this example are the same as those of the surface layer of the above Example 2 except fine particles of a polypropylene resin ("Texture 5378" from Shamrock Chemicals Co.; melting point 166° C.) are substituted for boron nitride in the above Example 2. The mixture is milled about 60 hours by using a ball mill. The mixture is sprayed to the above substrate of the intermediate transfer belt so that the surface layer of the intermediate transfer belt of this example is prepared.

As a result of the measurement of the above Example 5, the coefficient of static friction is 0.18, and the coefficient of dynamic friction is 0.15.

EXAMPLE 6 (EX.6)

The substrate of the intermediate transfer belt of this example is the same as that of the above Example 1.

The ingredients of the surface layer of this example are the same as those of the surface layer of the above Example 1 except N-lauroyl-L-lysine ("Famex L-12" from Ajinomoto Co., Inc.; melting point 230° C.) is substituted for molybdenum disulfide in the above Example 1. The mixture is milled about 60 hours by using a ball mill. The mixture is sprayed to the above substrate of the intermediate transfer belt so that the surface layer of the intermediate transfer belt of this example is prepared.

As a result of the measurement of the above Example 6, the coefficient of static friction is 0.18, and the coefficient of dynamic friction is 0.16.

EXAMPLE 7 (EX.7)

The substrate of the intermediate transfer belt of this example is the same as that of the above Example 2.

The ingredients of the surface layer of this example are the same as those of the surface layer of the above Example 2 except montan wan ("Luwax S" from BASF; melting point 82° C.) is substituted for boron nitride in the above Example 2. The mixture is milled about 60 hours by using a ball mill. The mixture is sprayed to the above substrate of the intermediate transfer belt so that the surface layer of the intermediate transfer belt of this example is prepared.

As a result of the measurement of the above Example 7, the coefficient of static friction is 0.20, and the coefficient of dynamic friction is 0.17.

EXAMPLE 8 (EX.8)

The substrate of the intermediate transfer belt of this example is the same as that of the above Example 2.

The ingredients of the surface layer of this example are the same as those of the surface layer of the above Example 2 except stearamide ("Kawaslip VL" from Kawaken Fine Chemicals Co., Ltd.; melting point 100° C.) is substituted for boron nitride in the above Example 2. The mixture is milled about 60 hours by using a ball mill. The mixture is sprayed to the above substrate of the intermediate transfer belt so that the surface layer of the intermediate transfer belt of this example is prepared.

As a result of the measurement of the above Example 8, the coefficient of static friction is 0.15, and the coefficient of dynamic friction is 0.12.

EXAMPLE 9 (EX.9) THROUGH EXAMPLE 13 (EX.13)

The intermediate transfer belts of these examples are the same as the intermediate transfer belt of the above Example 1 except the amount of carbon black contained in each intermediate transfer belt is varied from the amount of carbon black contained in the above Example 1 such that the volume resistivity of each intermediate transfer belt is varied as follows.

EX.9: $3\times10^{7}$ Ω·cm.

EX.10: $1\times10^{8}$ Ω·cm.

EX.11: $5\times10^{12}$ Ω·cm.

EX.12: $1\times10^{14}$ Ω·cm.

EX.13: $4\times10^{15}$ Ω·cm.

Others of these examples (EX.9 through Ex.13) are the same as those of the above Example 1.

EXAMPLE 14 (EX.14) THROUGH EXAMPLE 18 (EX.18)

The substrate of each of the intermediate transfer belts of these examples is the same as that of the above Example 2.

The ingredients of the surface layer of each example are the same as those of the surface layer of the above Example 2 except the amount of carbon black contained in each intermediate transfer belt is varied from the amount of carbon black contained in the above Example 2 such that the surface resistivity of each intermediate transfer belt is varied as follows.

EX.14: $4\times10^{6}$Ω.

EX.15: $1\times10^{7}$Ω.

EX.16: $8\times10^{9}$Ω.

EX.17: $1\times10^{13}$Ω.

EX.18: $6\times10^{14}$Ω.

Others of these examples (EX.14 through Ex.18) are the same as those of the above Example 2.

Further, the following comparative examples are prepared for the purpose of comparative analysis between the examples of the present invention and the comparative examples.

Comparative Example 1 (C.E.1)

The intermediate transfer belt of this comparative example 1 contains no molybdenum disulfide as in the above Example 1. Other components of the comparative example 1 are the same as corresponding components of the above Example 1.

As a result of the measurement of the comparative example 1, the coefficient of static friction is 0.45, and the coefficient of dynamic friction is 0.40.

Comparative Example 2 (C.E.2)

The intermediate transfer belt of this comparative example 2 contains no boron nitride as in the surface layer of the above Example 2. Other components of the comparative example 2 are the same as corresponding components of the above Example 2.

As a result of the measurement of the comparative example 2, the coefficient of static friction is 0.35, and the coefficient of dynamic friction is 0.31.

Next, a description will be given of the evaluation of test images reproduced by a full-color copier system in which the intermediate transfer belt prepared for each of the above examples and the above comparative examples is installed. A full-color copier system "Preter 550" from Ricoh Company Limited, which is commercially available, is used to reproduce test images for the evaluation with respect to the above examples and the above comparative examples. Each of the intermediate transfer belts prepared as the above examples of the present invention and the comparative examples is installed in the test copier system, so that each of the test images is reproduced by the test copier system. For each of the test images of the above examples and the comparative examples, a rating of the evaluation related to the non-transfer defect is given. Also, for each of the test images of the above examples and the comparative examples, an observation of other image defects is made. These results of the evaluation are shown in TABLES 1A and 1B which follows.

The rating of the evaluation of the test images related to the non-transfer defect is made in accordance with the following criterion.

Rank 5: The test image has no problem of the non-transfer defect.

Rank 4: Non-transfer spots in the test image are not almost visible to the human eye. The test image is acceptable in about more than 80%.

Rank 3: Non-transfer spots in the test image are visible to the human eye. The test image is acceptable in about 50%.

Rank 2: Non-transfer spots in the test image are visible to the human eye. The test image is acceptable in about 20%.

Rank 1: Non-transfer spots in the test image are visible to the human eye. The test image is not acceptable at all.

In the evaluation of the test images related to the non-transfer defect: test images of Rank 3, Rank 2 and Rank 1 are considered to be defective; and test images of Rank 4 and Rank 5 are the target.

TABLE 1A

| | Volume Resistivity (Ω · cm) | Surface Resistivity (Ω) | Static Friction Coefficient | Dynamic Friction Coefficient |
|---|---|---|---|---|
| EX. 1 | $2 \times 10^9$ | | 0.26 | 0.21 |
| EX. 2 | | $4 \times 10^{10}$ | 0.25 | 0.22 |
| EX. 3 | | | 0.18 | 0.13 |
| EX. 4 | | | 0.19 | 0.15 |
| EX. 5 | | | 0.18 | 0.15 |
| EX. 6 | | | 0.18 | 0.16 |
| EX. 7 | | | 0.20 | 0.17 |
| EX. 8 | | | 0.15 | 0.12 |
| EX. 9 | $3 \times 10^7$ | | | |
| EX. 10 | $1 \times 10^8$ | | | |
| EX. 11 | $5 \times 10^{12}$ | | | |
| EX. 12 | $1 \times 10^{14}$ | | | |
| EX. 13 | $4 \times 10^{15}$ | | | |
| EX. 14 | | $4 \times 10^6$ | | |
| EX. 15 | | $1 \times 10^7$ | | |
| EX. 16 | | $8 \times 10^9$ | | |
| EX. 17 | | $1 \times 10^{13}$ | | |
| EX. 18 | | $6 \times 10^{14}$ | | |
| C.E. 1 | | | 0.45 | 0.40 |
| C.E. 2 | | | 0.35 | 0.31 |

TABLE 1B

| | Melting point (°C.) | Rating of Non-transfer Defect | Observation of Other Image Defect |
|---|---|---|---|
| EX. 1 | | Rank 4 | none |
| EX. 2 | | Rank 5 | none |
| EX. 3 | | Rank 5 | none |
| EX. 4 | 128 | Rank 4 | none |
| EX. 5 | 166 | Rank 5 | none |
| EX. 6 | 230 | Rank 4 | none |
| EX. 7 | 82 | Rank 5 | none |
| EX. 8 | 100 | Rank 4 | none |
| EX. 9 | | Rank 4 | transfer dust |
| EX. 10 | | Rank 4 | transfer dust |
| EX. 11 | | Rank 4 | none |
| EX. 12 | | no image transferred | |
| EX. 13 | | no image transferred | |
| EX. 14 | | Rank 5 | transfer dust |
| EX. 15 | | Rank 5 | transfer dust |
| EX. 16 | | Rank 5 | none |
| EX. 17 | | Rank 5 | slight residual image |
| EX. 18 | | Rank 4 | residual image |
| C.E. 1 | | Rank 1 | none |
| C.E. 2 | | Rank 1 | low density |

Next, a description will be given of an image forming apparatus utilizing an intermediate transfer unit in another embodiment of the present invention, with reference to FIGS. 4 and 5.

Figure 4:
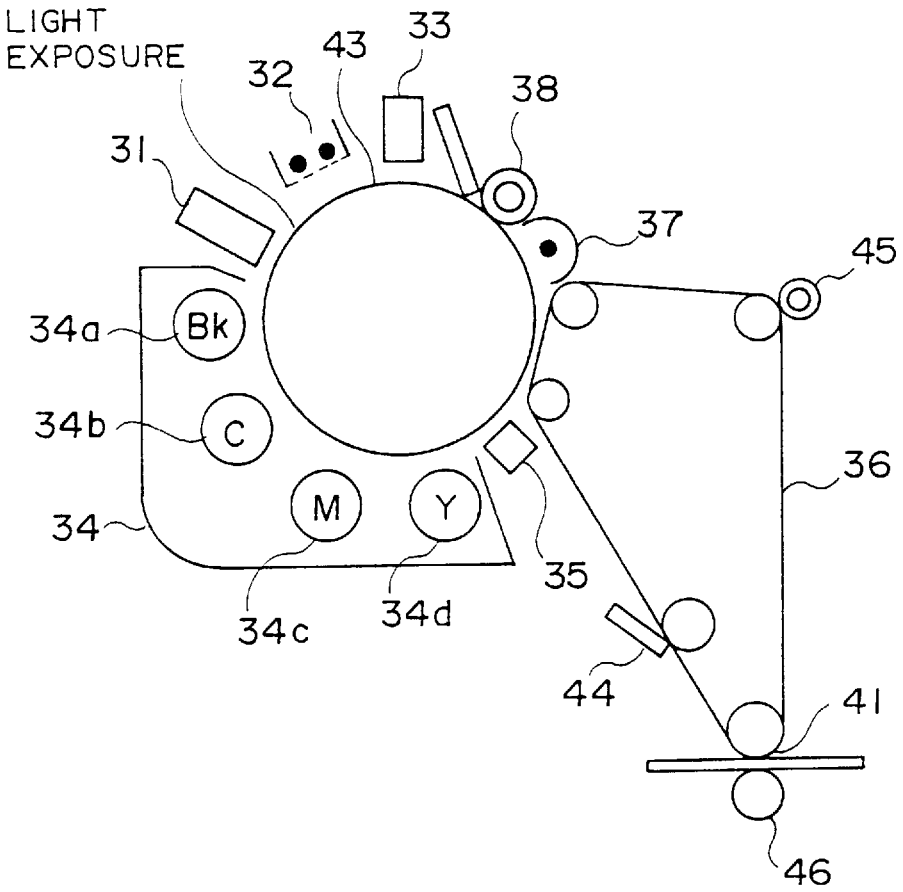
FIG. 4 is a diagram of an image forming apparatus in which an intermediate transfer unit in another embodiment of the present invention is incorporated.

FIG. 4 shows a full-color image forming apparatus to which the intermediate transfer unit of the present embodiment is applied.

The image forming apparatus, shown in FIG. 4, forms a set of developed color images on a rotary photoconductive drum 43 in accordance with the secondary-color-separated image signals by using color toners from a developing unit 34, the color toners corresponding to the secondary colors mentioned above. These developed color images are sequentially transferred to an intermediate transfer belt 36 during the first transfer process, so that an intermediate color image is formed on the intermediate transfer belt 36. The intermediate color image from the intermediate transfer belt 36 is transferred to a copy sheet at a second transfer region 41 during the second transfer process, so that a reproduced color image on the copy sheet is formed.

Referring to FIG. 4, the photoconductive drum 43 which is an electrophotographic photoconductive medium to carry a developed image thereon is rotated at a constant rate. At peripheral portions of the photoconductive drum 43, there are provided the developing unit 34, a potential sensor 31, a charging unit 32, a pattern sensor (P SENSOR) 35, the endless-belt-type intermediate transfer unit 41, a before-cleaning charge eliminating unit (Pcc) 37, a drum cleaning unit 38, and a charge eliminating lamp 33, similarly to those of the image forming apparatus of FIG. 1. The electrophotographic image forming process is carried out by these elements of the image forming apparatus.

The developing unit 34 includes a black (Bk) developing member 34*a*, a cyan (C) developing member 34*b*, a magenta (M) developing member 34*c*, and a yellow (Y) d eve loping member 34*d*. A toner or a developer of each developing member is a two-component developing agent which contains a coloring agent (toner) and a charge carrier.

When the electrophotographic image forming process for one of the secondary colors is started, the rotary photoconductive drum 43 is charged by the charging unit. An electrostatic latent image for the first one of the secondary colors is formed on the photoconductive drum 1 by an optical writing unit (not shown) in accordance with the color-separated image signal. A developed color image on the photoconductive drum 43 is formed with the toner from a corresponding developing member of the developing unit 34.

The developed color images on the photoconductive drum 43 are sequentially transferred to the intermediate transfer belt 36 so that an intermediate image on the intermediate transfer belt 36 is formed. The intermediate transfer belt 36 is rotated clockwise. The rotating speed of the intermediate transfer belt 36 is the same as the rotating speed of the rotary photoconductive drum 43. This transferring process is called the first transfer process.

After the first transfer process, the before-cleaning charge remaining on the photoconductive drum 43 is eliminated by the before-cleaning charge eliminating unit 33. The color toner which remains on the surface of the rotary photoconductive drum 43 after the first transfer process is removed by the drum cleaning unit 38.

The electrophotographic image forming process for subsequent ones of the secondary colors is performed. The above electrostatic latent image forming, the above color-toner developed image forming and the above first transfer process are repeated for each of the secondary colors C, M, Y and Bk. Since the above image forming processes for the subsequent ones of the secondary colors are repeated, a full-color intermediate image on the intermediate transfer unit 41 is formed.

The intermediate transfer belt 36 is an endless belt type. The endless belt member of the intermediate transfer belt 36 is arranged under the tensile stress by a drive roller, a belt-transfer biasing roller, a transfer-grounding roller and follower rollers. The intermediate transfer unit of the present embodiment is applicable to another type of intermediate transfer unit such as an intermediate transfer drum.

At peripheral portions of the intermediate transfer belt 36, there are provided a sweeper brush (St-Zn bar) 45, a sheet-transfer biasing roller 46 and a belt-cleaning unit 44, similarly to those of the image forming apparatus of FIG. 1. These elements are separated from the intermediate transfer belt 36 when the first transfer process for the secondary colors is being performed, and they are brought into contact with the intermediate transfer belt 36 during the second transfer process.

As the intermediate image on the intermediate transfer belt 36, the sheet-transfer biasing roller 41 is brought in contact with the intermediate transfer belt 36 via the copy sheet at the second transfer region 41. The intermediate image on the intermediate transfer belt 36 is transferred at the second transfer region 41 to the copy sheet, so that a reproduced color image on the copy sheet is formed.

The copy sheet on which the reproduced color image is formed is separated from the intermediate transfer belt 36 by a separating member (not shown). The copy sheet is transported by a transporting belt (not shown) to a fixing unit (not shown). After a fixing process for the copy sheet is finished by the fixing unit, the copy sheet with the reproduced color image is output from the image forming apparatus.

On the other hand, after the second transfer process is finished, the belt cleaning unit and the sweeper brush are brought into the intermediate transfer belt 36. The toner and charge which remains on the surface of the intermediate transfer belt 36 after the second transfer process is removed by the sweeper brush and the belt cleaning unit.

As described above, in order to obtain a desired level of optical density of the reproduced image, it is necessary that the transfer efficiency related to the transferring of the amount of toner (the intermediate image) on the intermediate transfer belt 36 to the amount of toner (the reproduced image) on the copy sheet is above 90%. Even if the transfer efficiency is above 90%, a small amount of toner may be left on the intermediate transfer belt 36 and not transferred to the copy sheet, which causes pinpoint spots in the reproduced image on the copy sheet to occur. In such a case, the reproduced image on the copy sheet includes the non-transfer spots. The occurrence of non-transfer spots in the reproduced image will lower the quality of the reproduced image. This problem is called the non-transfer defect.

The inventors of the present embodiment have found that an intermediate transfer unit having a surface layer of a mixture containing a fluorocarbon polymer component and a secondary resin component which are compatible with each other, allows the intermediate image on the intermediate transfer unit to be efficiently transferred to the copy sheet. Also, they have found that the intermediate transfer unit of the present embodiment provides a good toner-releasing characteristic for the image forming apparatus, thereby eliminating the problem of the non-transfer defect in the reproduced image. The fluorocarbon polymer component contained in the surface layer reduces a coefficient of friction on the surface layer of the intermediate transfer unit, and increases the transfer efficiency of the intermediate transfer unit.

It has been found desirable that the surface layer of the intermediate transfer unit has a coefficient of static friction which is below 0.4. It is observed that the problem of the non-transfer defect takes place if the coefficient of static friction of the intermediate transfer unit is above 0.4.

Specific examples of the fluorocarbon polymer component contained in the mixture of the surface layer of the intermediate transfer unit of the present embodiment are: polyvinylidene fluoride (PVDF), polytetrafluoroethylene (PTFE), tetrafluoroethyleneethylene copolymer (ETFE), polychlorotrifluoroethylene (PCTFE), tetrafluoroethylene-hexafluoropropylene copolymer (FEP), tetrafluoroethylene-hexafluoropropylene-vinylidenefluoride copolymer (THV), and so on.

It has been found that, among the above-mentioned examples, the PVDF and the THV are very suitable for use in the surface layer of the intermediate transfer unit, from the standpoint of the ease of molding of the intermediate transfer belt. In addition, it has been found desirable that the surface layer of the intermediate transfer unit has a coefficient of friction which is below 0.4. If the coefficient of friction is above 0.4, the toner-releasing characteristic of the intermediate transfer unit is lowered and the non-transfer defect on the reproduced color image is likely to occur. Further, if the coefficient of friction is above 0.4, the frictional load between the intermediate transfer belt 36 and the belt cleaning unit 44 becomes great and the cleaning characteristic of the intermediate transfer belt 36 will be lowered.

In order to allow the surface layer of the intermediate transfer unit of the present embodiment to have a coefficient of friction which is below 0.4, it is necessary to use the above-mentioned mixture containing a fluorocarbon polymer component and a secondary resin component which are compatible with each other, and to use such a filler that suitably adjusts the coefficient of friction of the surface layer.

Specific examples of the filler contained in mixture the surface layer of the intermediate transfer unit of the present embodiment are: a low-molecular-weight silicon-based or fluorine-based filler or resin particles such as a silicon oil or a silicon-based surface-active agent; a solid inorganic lubricant such as mica, graphite or molybdenum disulfide; a natural wax such as montan wax, carnauba wax or cured castor oil; a synthetic wax such as a fatty acid and its derivative, a fatty ester, a fatty acid amide or a monohydric or polyhydric alcohol fatty acid; and a general-purpose wax such as a polyethylene wax or a polypropylene wax.

Further, it has been found desirable that the surface layer of the intermediate transfer unit has a volume resistivity in the range between $1\times10^{8}$ Ω·cm and $1\times10^{13}$ Ω·cm. If the volume resistivity is below the range between $1\times10^{8}$ Ω·cm and $1\times10^{13}$ Ω·cm, a discharge of the transfer biasing charge of the contact area between the rotary photoconductive drum 43 and the intermediate transfer belt 36 is likely to occur. At this time, an irregularity in the reproduced image or a defective image will be produced. If the volume resistivity is above the range between $1\times10^{8}$ Ω·cm and $1\times10^{13}$ Ω·cm, an excessively high level of the transfer biasing charge is required to suitably transfer the developed color image on the rotary photoconductive drum 43 to the intermediate transfer belt 36. Further, at this time, the residual change in the intermediate transfer belt 36 may remain, and a residual image in the reproduced image is likely to occur.

Therefore, it is necessary that a suitable organic or inorganic conductive material be added to the resin mixture of the surface layer of the intermediate transfer unit so as to make the surface layer of the intermediate transfer unit have a volume resistivity in the range between $1\times10^{8}$ Ω·cm and $1\times10^{13}$ Ω·cm.

Specific examples of the inorganic conductive material contained in the surface layer of the intermediate transfer unit of the present embodiment are: a conductive whisker, carbon black, graphite, a carbon fiber, metallic particles and metallic oxide particles. Specific examples of the organic conductive material contained in the surface layer of the intermediate transfer unit of the present embodiment are: a polyethylene oxide, polypyrrole and a class-4 ammonium salt. It is necessary to adjust the amount of the conductive material contained in the surface layer of the intermediate transfer unit so as to make the surface layer of the intermediate transfer unit have a volume resistivity in the range between $1\times10^{8}$ Ω·cm and $1\times10^{13}$ Ω·cm. Two or more kinds of conductive material may be added to the resin mixture of the surface layer.

Further, it has been found that the intermediate transfer unit may have a multiple-layer structure, rather than a single-layer structure. It has been found desirable that at least the surface layer of the intermediate transfer unit has a surface resistivity per unit area in the range between $1\times10^{8}\Omega$ and $1\times10^{14}\Omega$. If the surface resistivity per unit area us below the range between $1\times10^{8}\Omega$ and $1\times10^{14}\Omega$, an irregularity in the reproduced image or a defective image will be produced. If the surface resistivity is above the range between $1\times10^{8}\Omega$ and $1\times10^{14}\Omega$, a residual image in the reproduced image is likely to occur.

As described above, the surface layer of the intermediate transfer unit of the present embodiment comprises the mixture containing the fluorocarbon polymer component and the secondary resin component which are compatible with each other. The fluorocarbon polymer component is a fluorocarbon-based copolymer containing at least two of polyvinylidene fluoride, vinylidene fluoride, tetrafluoroethylene, and hexafluoropropylene. It is necessary to adjust the weight ratio of the components of the fluorocarbon-based copolymer so as to suit it to the practical condition of the molding of the intermediate transfer belt 36.

In the mixture of the surface layer of the intermediate transfer unit of the present embodiment, the secondary resin component (A) is added to the fluorocarbon polymer component. This is because the surface layer containing only the fluorocarbon polymer shows an excessively negative polarity which may be unsuitable to the toner from the developing unit. If a negatively charged type toner is used, the toner on the surface layer of the intermediate transfer unit containing only the fluorocarbon polymer is charged in the opposite polarity. In this case, the non-transfer defect in the reproduced image is likely to occur. Therefore, it is necessary to suitably adjust the quantity of frictional charge of the mixture of the surface layer with the toner by using a selected amount of the secondary resin component (A) contained in the mixture of the surface layer.

It has been found desirable that the mixture of the surface layer of the intermediate transfer unit has an absolute value of the quantity of frictional charge with the toner in the range between 0 and 40 μc/g. In the present embodiment, this absolute value of the quantity of frictional charge of the mixture with the toner is adjusted by using a selected amount of the secondary resin component (A) contained in the mixture of the surface layer. The selected amount of the secondary resin component (A) in the present embodiment is determined based on a measured value of the quantity of frictional charge of the sample (the mixture) with the toner.

Figure 5:
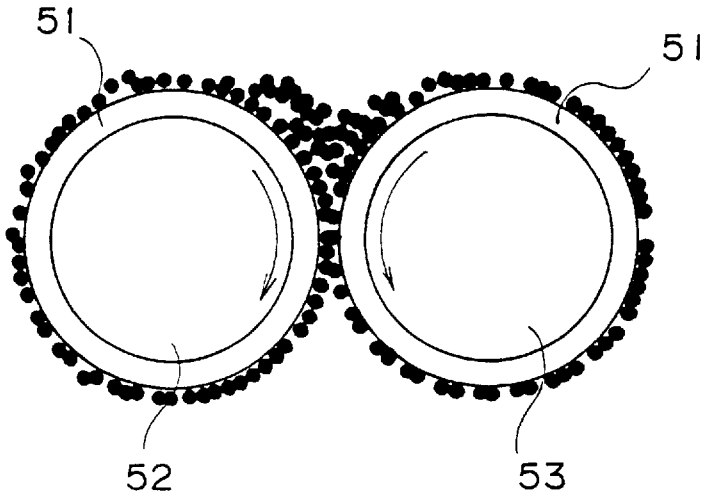
FIG. 5 is a diagram of a measuring device which measures an absolute value of quantity of frictional charge of a sample with a toner for the image forming apparatus of FIG. 4.

FIG. 5 shows a measuring device which measures an absolute value of quantity of frictional charge of a sample with a toner for the image forming apparatus of FIG. 4.

As shown in FIG. 5, the measuring device includes a first metallic roller 52 and a second metallic roller 53 which are arranged with a gap between the two rollers 52 and 53. The two rollers 52 and 53 are made of, for example, a stainless steel material. Each of the rollers 52 and 53 is covered with a sample 51 of the mixture of the surface layer of the intermediate transfer belt 36. The rollers 52 and 53 are rotated at different linear speeds in opposite rotational directions as indicated by the arrows in FIG. 5. A given amount of the toner is added to an intermediate area between the two rollers 52 and 53. When the two rollers 52 and 53 are rotated as mentioned above, the toner in the intermediate area is taken in by using a suction device. A value of the quantity of frictional charge related to the intake toner is measured by using an electrometer. Further, a weight of the intake toner is measured. Then, an absolute value of the quantity of frictional charge of the sample 51 with the toner is calculated from the measured weight and the measured value of the quantity of frictional charge. That is, the absolute value of the quantity of frictional charge indicates a quantity of frictional charger of the sample per unit weight of the toner.

The specifications of the measuring device shown in FIG. 5 are as follow.

Diameter of each of the rollers 52 and 53: 100 mm

Linear speed of the roller 52: about 100 mm/sec

Linear speed of the roller 53: about 105 mm/sec

The gap between the rollers 52 and 53: 20 μm

Duration of the rotation: 30 seconds

Taking into account the characteristic of the quantity of frictional charge with the toner, it has been found that desirable examples of the secondary resin component (A) contained in the mixture of the surface layer of the intermediate transfer unit are: an acrylic resin and a polyether resin. Specific examples of the acrylic resin for the secondary resin component (A) are: polymethylmethacrylate, 2-hydroxymethacrylate, butylmethacrylate, 2-ethylhexylmethacrylate, arylmethacrylate, glycithylmethacrylate, their copolymers or derivatives, acrylic rubber, and so on. Specific examples of the polyether resin for the secondary resin component (A) are: polyethylene oxide, polypropylene oxide, polyether amide, polyether ester amide, chlorinated polyether, polyacetal, epichlorohydrin rubber, polyether urethane rubber, and so on.

Further, it has been found desirable that a weight ratio (F/A) of the fluorocarbon polymer component (F) to the secondary resin component (A) in the mixture of the surface layer of the intermediate transfer unit is in the range between 5/5 and 8/2. If the weight ratio is above the range between 5/5 and 8/2, the characteristic of the quantity of frictional charge of the mixture with the toner becomes too low, and the non-transfer defect in the reproduced image is likely to occur. If the weight ratio is below the range between 5/5/ and 8/2, the coefficient of friction becomes too great or the toner-releasing characteristic becomes too low. Also, at this time, the non-transfer defect in the reproduced image is likely to occur.

Further, it has been found desirable that the secondary resin component (A) of the mixture of the surface layer of the intermediate transfer unit has a volume specific resistivity in the range between $1\times10^{8}$ Ω·cm and $1\times10^{12}$ Ω·cm. If the above-mentioned secondary resin component (A) is contained in the surface layer of the intermediate transfer unit, adding another material to the mixture in order to adjust the volume specific resistivity is no longer needed, or the desired result will be obtained if a small amount of another material is added to the mixture.

The surface resistivity and the volume resistivity of the examples are measured by using a measuring instrument "Hiresta" from Mitsubishi Petrochemical Co., Ltd. The applied voltage is 500 V, and the measuring time is 10 seconds.

The coefficient of static friction of the examples are measured by using an analyzer "Friction Abrasion Analyzer DF.PM-SS" from Kyowa Interface Science Co., Ltd. A measuring load of the stainless-steel ball of this analyzer during the test is set to 100 g.

EXAMPLE 31 (EX.31)

| | |
|---|---|
| tetrafluoroethylene-hexafluoropropylene-vinylidenefluoride copolymer ("THV500" from Sumitomo 3M Limited) | 100 parts by weight |
| conductive whisker ("Dentor WK200B" from Ohtsuka Chemical Co., Ltd.) | 65 parts by weight |
| acrylic resin | 43 parts by weight |

A seamless intermediate transfer belt of this Example 31 is prepared by performing extrusion molding of the mixture of the above ingredients.

EXAMPLE 32 (EX.32)

| | |
|---|---|
| polyvinylidene fluoride ("KF850" from Kureha Chemical Industry Co., Ltd.) | 100 parts by weight |

In this Example 32, the polyvinylidene fluoride mentioned above is substituted for the tetrafluoroethylene-hexafluoropropylene-vinylidenefluoride copolymer in the Example 31. The other ingredients are the same as those of the Example 31. A seamless intermediate transfer belt of the Example 32 is prepared in the same way.

EXAMPLE 33 (EX.33)

| | |
|---|---|
| tetrafluoroethylene-hexafluoropropylene copolymer ("Neoflon FEP" from Daikin Industries Ltd.) | 100 parts by weight |

In this Example 33, the tetrafluoroethylene-hexafluoropropylene copolymer mentioned above is substituted for the tetrafluoroethylene-hexafluoropropylene-vinylidenefluoride copolymer in the Example 31. The other ingredients are the same as those of the Example 31. A seamless intermediate transfer belt of the Example 33 is prepared in the same way.

EXAMPLE 34 (EX.34)

| | |
|---|---|
| acrylic rubber ("PA401" from NOK Corp.) | 30 parts by weight |

In this Example 34, the acrylic rubber mentioned above is substituted for the tetrafluoroethylene-hexafluoropropylene-vinylidenefluoride copolymer in the Example 31. The other ingredients are the same as those of the Example 31. A seamless intermediate transfer belt of the Example 34 is prepared in the same way.

EXAMPLE 35 (EX.35) THROUGH EXAMPLE 38 (EX.38)

The intermediate transfer belts of these examples are the same as the intermediate transfer belt of the above Example 31 except the amount of the conductive whisker contained in each intermediate transfer belt is different from the amount of the conductive whisker contained in the above Example 31 as follows.

EX.35: 50 parts by weight

EX.36: 60 parts by weight

EX.37: 70 parts by weight

EX.38: 80 parts by weight

EXAMPLE 39 (EX.39)

| (Ingredients of Substrate) | |
|---|---|
| tetrafluoroethylene-hexafluoropropylene-vinylidenefluoride copolymer ("THV500" from Sumitomo 3M Limited) | 100 parts by weight |
| conductive whisker ("Dentor WK200B" from Ohtsuka Chemical Co., Ltd.) | 65 parts by weight |

A substrate of a seamless intermediate transfer belt of this Example 39 is prepared by performing extrusion molding of the mixture of the above ingredients. The resulting substrate is sprayed with a mixture of the following ingredients for a surface layer of the intermediate transfer belt of this Example 39. The intermediate transfer belt after the spraying is dried at 150° C. for 10 minutes. The intermediate transfer belt of the Example 39 is prepared.

| (Ingredients of Surface Layer) | |
|---|---|
| a mixture paint of tetrafluoroethylene-hexafluoropropylene-vinylidenefluoride copolymer and acrylic resin ("Novafusso PF250" from Dai Nippon Shikizai Kogyo Co., Ltd.) | 100 parts by weight (solid) |
| conductive whisker ("Dentor WK200B" from Ohtsuka Chemical Co., Ltd.) | 25 parts by weight |

EXAMPLE 40 (EX.40)

The seamless intermediate transfer belt of this Example 40 is the same as that of the above Example 39 except 5 parts by weight of N-lauroyl-L-lysine ("Famex L-12" from Ajinomoto Co., Inc.) is added to the mixture of the ingredients of the surface layer in the above Example 39. The intermediate transfer belt of this Example 40 is prepared in the same way.

EXAMPLE 41 (EX.41) THROUGH EXAMPLE 43 (EX.43)

The intermediate transfer belts of these examples are the same as the intermediate transfer belt of the above Example 40 except the amount of the conductive whisker contained in each intermediate transfer belt is different from the amount of the conductive whisker contained in the above Example 40 as follows.

EX.41: 10 parts by weight

EX.42: 20 parts by weight

EX.43: 30 parts by weight

EXAMPLE 44 (EX.44) THROUGH EXAMPLE 47 (EX.47)

The intermediate transfer belts of these examples are the same as the intermediate transfer belt of the above Example 31 except the weight ratio (F/A) of the fluorocarbon resin component (F) to the secondary resin component (A) in each intermediate transfer belt is different from the weight ratio (F/A) of the fluorocarbon resin component (F) to the secondary resin component (A) in the above Example 31 as follows.

EX.44: 9/1

EX.45: 8/2

EX.46: 5/5

EX.47: 4/6

EXAMPLE 48 (EX.48)

| | |
|---|---|
| tetrafluoroethylene-hexafluoropropylene-vinylidenefluoride copolymer ("THV500" from Sumitomo 3M Limited) | 100 parts by weight |
| conductive whisker ("Dentor WK200B" from Ohtsuka Chemical Co., Ltd.) | 30 parts by weight |
| polyether ester amide ("Pepax 6333" from Toray Industries, Inc.) | 30 parts by weight |

The seamless intermediate transfer belt of this Example 48 is prepared by performing extrusion molding of the mixture of the above ingredients.

EXAMPLE 49 (EX.49)

The seamless intermediate transfer belt of this Example 49 is the same as that of the above Example 39 except 8 parts by weight of amino silane ("KBM603" from Shin-Etsu Chemical Co., Ltd.) is added to the mixture of the ingredients of the surface layer in the above Example 39. The intermediate transfer belt of this Example 49 is prepared in the same way as the above Example 39.

EXAMPLE 50 (EX.50)

The seamless intermediate transfer belt of this Example 50 is the same as that of the above Example 39 except 12 parts by weight of amino silane ("KBM603" from Shin-Etsu Chemical Co., Ltd.) is added to the mixture of the ingredients of the surface layer in the above Example 39. The intermediate transfer belt of this Example 50 is prepared in the same way as the above Example 39.

Further, the following comparative examples are prepared for the purpose of comparative analysis between the above Examples and the comparative examples.

Comparative Example 31 (C.E.31)

The intermediate transfer belt of this comparative example 31 contains no acrylic resin on the surface layer as in the above Example 31. Other components of the comparative example 31 are the same as corresponding components of the above Example 31.

Comparative Example 32 (C.E.32)

The intermediate transfer belt of this comparative example 32 contains no acrylic resin on the surface layer as in the above Example 32. Other components of the comparative example 32 are the same as corresponding components of the above Example 32.

Next, a description will be given of the evaluation of test images reproduced by a full-color copier system in which the intermediate transfer belt prepared for each of the above examples and the above comparative examples is installed. A full-color copier system "Preter 550" from Ricoh Company Limited, which is commercially available, is used to reproduce test images for the evaluation with respect to the above examples and the above comparative examples. Each of the intermediate transfer belts prepared as the above examples of the present invention and the comparative examples is installed in the test copier system, so that each of the test images is reproduced by the test copier system. For each of the test images of the above examples and the comparative examples, a rating of the evaluation related to the non-transfer defect is given. Also, for each of the test images of the above examples and the comparative examples, an observation of other image defects is made. These results of the evaluation are shown in TABLES 2A, 2B and 2C which follows.

The rating of the evaluation of the test images related to the non-transfer defect is made in accordance with the following criterion.

Rank 5: The test image has no problem of the non-transfer defect.

Rank 4: Non-transfer spots in the test image are not almost visible to the human eye. The test image is acceptable in about more than 80%.

Rank 3: Non-transfer spots in the test image are visible to the human eye. The test image is acceptable in about 50%.

Rank 2: Non-transfer spots in the test image are visible to the human eye. The test image is acceptable in about 20%.

Rank 1: Non-transfer spots in the test image are visible to the human eye. The test image is not acceptable at all.

In the evaluation of the test images related to the non-transfer defect: test images of Rank 2 and Rank 1 are considered to be defective; and test images of Rank 3, Rank 4 and Rank 5 are the target.

Regarding the carrier, the silicon resin coat carrier is used. Regarding the toner, a negative charge cyan toner which is specified below is used:

| | |
|---|---|
| Epoxy resin | 100 parts by weight |
| Copper phthalocyanine | 1.5 parts by weight |
| Derivative of zinc salicylate | 1.5 parts by weight |

The mixture of the above ingredients is fused and kneaded. The resulting mixture is ground such that fine particles with about 7 $\mu$m diameter are obtained. 100 parts by weight of the fine particles and 0.7 parts by weight of hydrophobic silica are mixed by using a mixer. The toner which is prepared as mentioned above is used.

TABLE 2A

| | Static Friction Coefficient | Volume Resistivity ($\Omega \cdot$ cm) | Surface Resistivity ($\Omega$) |
|---|---|---|---|
| EX. 31 | 0.33 | $3.0 \times 10^{10}$ | $3.5 \times 10^{10}$ |
| EX. 32 | 0.30 | $2.1 \times 10^{10}$ | $1.9 \times 10^{10}$ |
| EX. 33 | 0.35 | $5.3 \times 10^{10}$ | $5.5 \times 10^{10}$ |
| EX. 34 | 0.48 | $2.4 \times 10^{9}$ | $2.2 \times 10^{9}$ |
| EX. 35 | 0.33 | $6.5 \times 10^{12}$ | $6.6 \times 10^{12}$ |
| EX. 36 | 0.32 | $7.4 \times 10^{12}$ | $8.0 \times 10^{12}$ |
| EX. 37 | 0.32 | $2.0 \times 10^{8}$ | $2.3 \times 10^{4}$ |
| EX. 38 | 0.33 | $3.3 \times 10^{6}$ | $3.2 \times 10^{4}$ |
| EX. 39 | 0.42 | — | $3.4 \times 10^{10}$ |
| EX. 40 | 0.22 | — | $8.4 \times 10^{10}$ |

TABLE 2A-continued

| | Static Friction Coefficient | Volume Resistivity (Ω · cm) | Surface Resistivity (Ω) |
|---|---|---|---|
| EX. 41 | 0.23 | — | $4.3 \times 10^{14}$ |
| EX. 42 | 0.22 | — | $5.6 \times 10^{12}$ |
| EX. 43 | 0.24 | — | $2.1 \times 10^{8}$ |
| EX. 48 | 0.35 | $4.6 \times 10^{11}$ | $4.4 \times 10^{11}$ |

TABLE 2B

| | Rating of Non-transfer Defect | Observation of Other Image Defect |
|---|---|---|
| EX. 31 | Rank 5 | none |
| EX. 32 | Rank 5 | none |
| EX. 33 | Rank 5 | none |
| EX. 34 | Rank 3 | none |
| EX. 35 | Rank 5 | residual image |
| EX. 36 | Rank 5 | none |
| EX. 37 | Rank 5 | slight transfer dust |
| EX. 38 | Rank 5 | transfer dust |
| EX. 39 | Rank 4 | none |
| EX. 40 | Rank 5 | none |
| EX. 41 | Rank 5 | residual image |
| EX. 42 | Rank 5 | none |
| EX. 43 | Rank 5 | slight transfer dust |
| EX. 48 | Rank 5 | none |

TABLE 2C

| | Weight Ratio of Comp. (F) to Comp. (A) | Quantity of Frictional Charge (μc/g) | Rating of Non-transfer Defect |
|---|---|---|---|
| EX. 44 | 9/1 | +20.8 | Rank 3 |
| EX. 45 | 8/2 | +10.0 | Rank 4 |
| EX. 31 | 7/3 | −14.6 | Rank 5 |
| EX. 46 | 5/5 | −28.7 | Rank 5 |
| EX. 47 | 4/6 | −45.1 | Rank 3 |
| EX. 39 | | −12.2 | Rank 5 |
| EX. 49 | | −34.8 | Rank 4 |
| EX. 50 | | −52.2 | Rank 3 |
| C.E. 31 | | +35.1 | Rank 1 |
| C.E. 32 | | +28.8 | Rank 2 |

What is claimed is:

1. An image forming apparatus comprising:

a photoconductive medium;

an intermediate transfer unit associated with the photoconductive medium;

a first unit for transferring a developed image on the photoconductive medium to the intermediate transfer unit such that an intermediate image on the intermediate transfer unit is formed; and a second unit for transferring the intermediate image from the intermediate transfer unit to a copy sheet such that a reproduced image on the copy sheet is formed, said intermediate transfer unit comprising a surface layer of a mixture containing a friction reducing substance which reduces a coefficient of friction on said surface layer.

2. The image forming apparatus according to claim 1, wherein the surface layer of the intermediate transfer unit has a coefficient of static friction which is below 0.3 and a coefficient of dynamic friction which is below 0.3.

3. The image forming apparatus according to claim 1, wherein the friction reducing substance is a solid inorganic lubricant.

4. The image forming apparatus according to claim 1, wherein the mixture contains fine particles of an organic resin as the friction reducing substance.

5. The image forming apparatus according to claim 4, wherein the organic resin contained in the mixture is a polyolefin resin.

6. The image forming apparatus according to claim 4, wherein the organic resin contained in the mixture is one of a long-chain fatty acid, a derivative of the fatty acid, and a compound including the fatty acid and/or the derivative, said fatty acid having twelve or greater carbon atoms and having a melting point of 50° C. or above.

7. The image forming apparatus according to claim 1, wherein the surface layer of the intermediate transfer unit has a volume resistivity in the range between $1\times10^{8}$ Ω·cm and $1\times10^{14}$ Ω·cm.

8. The image forming apparatus according to claim 1, wherein the intermediate transfer unit has a laminated structure including at least two layers.

9. The image forming apparatus according to claim 8, wherein the surface layer of the intermediate transfer unit has a surface resistivity per unit area in the range between $1\times10^{7}$Ω and $1\times10^{13}$Ω.

10. The apparatus according to claim 1, wherein the mixture contains fine particles of an organic resin as the friction reducing substance, and said organic resin is one of a long-chain fatty acid, a derivative of the fatty acid, and a compound including the fatty acid and/or the derivative.

11. An image forming apparatus comprising:

a photoconductive medium;

an intermediate transfer unit associated with the photoconductive medium;

a first unit for transferring a visible developed color image on the photoconductive medium to the intermediate transfer unit such that an intermediate color image on the intermediate transfer unit is formed; and a second unit for transferring the intermediate color image from the intermediate transfer unit to a copy sheet such that a reproduced color image on the copy sheet is formed, wherein said intermediate transfer unit comprises a surface layer of a mixture containing a fluorocarbon polymer component and a secondary resin component which are compatible with each other, the visible developed color image being formed on said surface layer.

12. An intermediate transfer device for use in an image forming apparatus which comprises:

a photoconductive medium;

a first unit for transferring a visible developed color image from the photoconductive medium to the intermediate transfer device such that an intermediate color image on the intermediate transfer device is formed; and a second unit for transferring the intermediate color image from the intermediate transfer device to a copy sheet such that a reproduced color image on the copy sheet is formed, said intermediate transfer device comprising a surface layer of a mixture containing a fluorocarbon polymer component and a secondary resin component which are compatible with each other, the visible developed color image being formed on said surface layer.

13. The intermediate transfer device according to claim 12, wherein the fluorocarbon polymer component is a fluorocarbon-based copolymer containing at least two of polyvinylidene fluoride, vinylidene fluoride, tetrafluoroethylene, and hexafluoropropylene.

14. The intermediate transfer device according to claim 12, wherein the surface layer of the intermediate transfer device has a coefficient of friction which is below 0.4.

15. The intermediate transfer device according to claim 12, wherein the intermediate transfer device has a volume resistivity in the range between $1\times10^{8}$ Ω·cm and $1\times10^{13}$ Ω·cm.

16. The intermediate transfer device according to claim 12, wherein the intermediate transfer device has a laminated structure including at least two layers, the surface layer having a surface resistivity per unit area in the range between $1\times10^{8}$Ω and $1\times10^{14}$Ω.

17. The intermediate transfer device according to claim 12, wherein the mixture of the surface layer of the intermediate transfer device has an absolute value of quantity of frictional charge with a toner in the range between 0 and 40 μc/g.

18. The intermediate transfer device according to claim 12, wherein the secondary resin component is one of an acrylic resin and a polyether resin.

19. The intermediate transfer device according to claim 12, wherein a weight ratio of the fluorocarbon polymer component to the secondary resin component in the mixture is in the range between 5/5 and 8/2.

20. The intermediate transfer device according to claim 12, wherein the secondary resin component of the mixture has a volume specific resistivity in the range between $1\times10^{8}$ Ω·cm and $1\times10^{12}$ Ω·cm.

* * * * *